United States Patent [19]

Ishii et al.

[11] Patent Number: 4,600,628

[45] Date of Patent: Jul. 15, 1986

[54] THERMAL TRANSFER RECORDING MEDIUM

[75] Inventors: Fumio Ishii, Akishima; Yoshihiro Inaba, Hachioji, both of Japan

[73] Assignee: Konishiroku Photo Industry Co., Ltd., Tokyo, Japan

[21] Appl. No.: 706,004

[22] Filed: Feb. 27, 1985

[30] Foreign Application Priority Data

Mar. 2, 1984 [JP] Japan ..... 59-38824

[51] Int. Cl.[4] ..... B41M 5/26

[52] U.S. Cl. ..... 428/216; 427/146; 427/152; 427/333; 427/385.5; 428/195; 428/207; 428/336; 428/484; 428/488.1; 428/913; 428/914

[58] Field of Search ..... 346/200, 204, 226; 428/195, 203, 204, 207, 484, 488.1, 488.4, 913, 914, 213–216, 211, 336, 480; 427/146, 152, 258, 333, 372.2, 384, 385.5

[56] References Cited

FOREIGN PATENT DOCUMENTS 0071647 6/1979 Japan ..... 428/195

*Primary Examiner*—Bruce H. Hess

*Attorney, Agent, or Firm*—Frishauf, Holtz, Goodman & Woodward

[57] ABSTRACT

A thermal transfer recording medium comprising a support, an interlayer provided on said support and a coloring agent layer provided on said interlayer. The interlayer contains a cross-linking agent and the coloring agent layer contains a coloring agent and a reactive polymer. The transfer recording medium can be used repeatedly to provide printed copies of excellent quality.

27 Claims, 1 Drawing Figure

THERMAL TRANSFER RECORDING MEDIUM

BACKGROUND OF THE INVENTION

1. Field of the Invention

The present invention relates to a thermal transfer recording medium capable of being used repeatedly and more particularly to a thermal transfer recording medium wherein a density drop caused by the increase in the number of usage thereof is small, printing with low energy can be performed and the print quality of high density and excellent resolving power is obtained.

2. Description of the Prior Art

An example of the invention of a thermal transfer recording medium intended to be used repeatedly is described in Japanese Patent Publication Open to Public Inspection No. 68253/1979. This invention employs the technology wherein resins are used to form a finely-porous layer and heat-melting ink is impregnated in the holes and clearances in the porous layer. However the technology has disadvantageous points that the density of a dye-transfer image is low, high energy is necessary to obtain dye-transfer images with high density and the edge of the printed images lacks the sharpness even if dye-transfer images with high density may be obtained owing to the high energy impressed. Even in Japanese Patent Publication Open to Public Inspection No. 105579/1980, technology similar to the foregoing is disclosed and the same disadvantage is observed therein.

Besides the foregoing, various thermal transfer recording media capable of being used repeatedly have been devised. For example, the method wherein vinyl monomer is grafted to carbon black as is disclosed in Japanese Patent Publication Open to Public Inspection No. 185195/1982 and the method wherein an interlayer for the purpose of adhesion is provided between the substrate and the ink layer (layer of heat-melting coloring agent) as is shown in Japanese Patent Publication Open to Public Inspection Nos. 36698/1982, 138984/1982, 116193/1983 and 155995/1983 are widely known. In the methods mentioned above, transference at the same time of all coloring agents same time when heated by a thermal head and each technology is effective to a certain extent but still is insufficient.

SUMMARY OF THE INVENTION

Objects of the Invention

An object of the present invention is to provide a thermal transfer recording medium capable of being printed under low energy, capable of having less density-drop for repeated usage and capable of providing dye-transfer images with high density repeatedly.

Another object of the present invention will be cleared by the following description in the present specification.

Summary of the Invention

The inventors of the present invention, after the intensive study, found that aforesaid object may be accomplished in the thermal transfer recording medium having an interlayer and a heat-melting coloring agent layer each of which being coated successively on the substrate, wherein aforesaid interlayer contains cross-linking agents and aforesaid coloring agent layer contains reactive polymers.

Effects of the Invention

Since the cross-linking agents contained in the foundation layer formed on the substrate and the reactive polymers contained in the heat-melting color agent layer mutually react and thereby the heat-melting coloring agent layer can firmly be held on the substrate, the present invention causes the printing for plural times to be feasible and particularly improves remarkably the density drop for the second printing and the printings thereafter.

DETAILED DESCRIPTION OF THE INVENTION

Structure of the Invention

Figure 1:
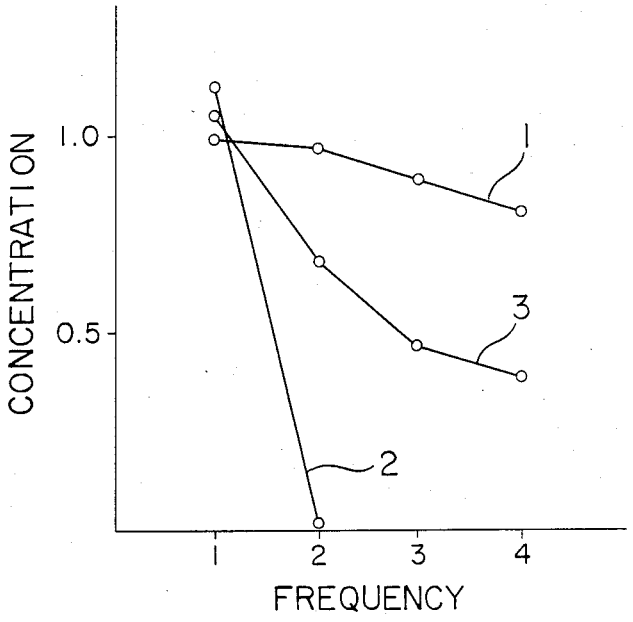
FIG. 1 is a graph showing the correlation between the number of printing operations and the densities corresponding to aforesaid printing operations regarding the sample of the thermal transfer recording medium of the present invention and the line "1" in the graph is for the sample "1" of the present invention and the lines "2" and "3" are for the comparative samples "2" and "3" respectively.

Further explanation of the present invention will be made in detail as follows.

Following structure is the lowest level to be held by the thermal transfer recording medium of the present invention. Namely, the structure contains an interlayer containing cross-linking agents and a heat-melting coloring agent layer containing reactive polymers both of which are coated successively on the substrate.

It is preferable that the reactive polymers to be contained in the heat-melting coloring agent layer are the substance having the reactive group (active functional group) on the side chain of polymer. Concrete examples of the reactive group include, for example, epoxy group, aziridinyl group, isocyanate group, thioisocyanate group, lactone group (e.g. $\beta$-lactone group), ketene group, azlactone group, aldehyde group, vinyl group, amino group, mercapto group, acid hydrazide group, hydroxamic acid group, sulfonic acid chloride, acid azide group, sulfonic acid group, acid hydride group and triazine group etc.

Following is a detailed description on the reactive high molecular substance of the present invention.

The concrete examples of the monomer to be used for the preparation of the reactive polymer that is used in the present invention include the following.

A monomer having an epoxy group includes, for example, glycidyl acrylate, glycidyl methacrylate, acrylglycidyl ether, 4-vinylcyclohexanmonoepoxide and others.

A monomer having an aziridyl group includes, for example, aziridylethylmethacrylate, 1-ethylenesulfonylaziridine, 1-ethylenecarbonylaziridine, aziridylethylacrylate and others. As a monomer having a formyl group, acrolein, methacrolein and others, for example, may be given. A monomer having a hydroxymethyl group includes, for example, N-methylolacrylamide, N-methylolmethacrylamide, N-methyloldiacetoacrylamide and others. A monomer having an isocyanate group includes, for example, vinylisocyanate, allylisocyanate and others. As a monomer having a thiol group, vinylthiol, p-thiolstylene, m-thiolstylene, vinylbenzylthiol and their acetylated compound, for example, and given. A monomer having a carbamoyl group includes, for example, acrylamide, methacrylamide, maleic amide, diacetoneacrylamide and others.

As the other monomer that copolymerizes with a monomer having aforesaid reactive groups, various types of monomers may be used. For example, styrene, vinyl toluene, vinyl benzyl chloride, t-butyl styrene, methacrylic acid methyl, acrylic acid methyl, acrylonitrile, methacrylonitrile, divinylbenzene, N,N-methylenebis(acrylamide), ethylene diacrylate, ethylenedimethacrylate, vinyl chloride, vinylidene chloride and others may be given.

A heat-melting coloring agent layer of the present invention is, in addition to aforesaid reactive polymers, composed mainly of substances with a low melting point, coloring agents and of softening agents and the substances with a low melting point include solid substance or semisolid substance both with a melting point (measured values obtained by Type MPJ-2 of Yanagimoto) of 40° C.–120° C. Besides the wax group including plant wax such as carnauba wax, vegetable wax, ouricury wax, esparto wax and others, animal wax such as beeswax, insect wax, shellac wax, spermaceti and other, petroleum wax such as paraffin wax, microcrystalline wax, ester wax, oxidized wax and others and mineral wax such as montan wax, ozokerite, ceresin and others, the concrete examples of the aforesaid substances with a low melting point are higher fatty acid such as palmitic acid, stearic acid, margaric acid, behenic acid and other; higher alcohol such as palmityl alcohol, stearyl alcohol, behenyl alcohol, marganyl alcohol, myricyl alcohol, eicosanol and others; higher fatty acid ester such as palmitic acid cetyl, palmitic acid myricyl, stearic acid cetyl, stearic acid myricyl and others; amide group such as acetamide, propionic acid amide, palmitic acid amide, stearic acid amide, amide wax and others; resin derivatives such as ester gum, rosin maleic acid resin, rosin phenol resin, hydrofined rosin and others; polymer with a softening point of 50° C.–120° C. such as phenol resin, terpene resin, cyclopentadiene resin, aromatic resin and others; higher amines such as stearyl amine, behynyl amine, palmitin amine and others; and polyethyleneoxide such as polyethylene glycol 4000, polyethylene glycol 6000 and others, all of which may be used independently or in combination. Among the substances with a low melting point mentioned above, higher amides such as palmitic acid amide, stearic acid amide, oleic acid amide, amide wax and others are particularly preferable. It is further possible to use "the heat-melting solid substance in the solid state at room temperature" described in Japanese Patent Publication Open to Public Inspection No. 68253/1979 and "the vehicle" described in Japanese Patent Publication Open to Public Inspection No. 105579/1980.

Coloring agents used in the present invention may properly be selected from the dyes which have widely been known and it is possible to select from direct dyes, acid dyes, basic dyes, disperse dyes, oil-soluble dyes (including metal-oil-soluble dyes) and others. Dyes used in the coloring agent layer of the present invention may be the dyes capable of being transferred (moved) together with heat-melting substances and therefore they may also be the pigments in addition to the foregoings. Concrete examples of them are as follows. Namely, as a yellow dye, Kayaron-polyester-light-yellow 5G-S (Nihon kayaku), Oilyellow S-7 (Shirado), Aizenspiron GRH special (Hodogaya), Sumiplastoyellow FG (Sumitomo), Aizenspiron-yellow GRH (Hodogaya) etc. are favorably used. As a red dye, Diacellitonfast-red R (Mitsubishi Kasei), Dianix-brilliant-red BS-E (Mitsubishi Kasei), Sumiplasto-red FB (Sumintomo), Sumiplasto-red HFG (Sumitomo), Kayaron-polyester-pink PCL-E (Nikon Kayaku), Aizenspiron-red GEH special (Hodogaya) etc. are favorably used. As a blue dye, Diacelliton-fast-brilliant-blue R (Mitsubishi Kasei), Dianix blue EB-E (Mitsubishi Kasei), Kayaron-polyester-blue B-SF conc (Nikon Kayaku), Sumiplasto-blue 3R (Sumitomo), Sumiplasto-blue G (Sumitomo) etc. are favorably used. Further, as a yellow pigment, Hansa yellow 3G and Tartrazine-Lake etc. are used, as a red pigment, Brilliant-carmine FB pure (San-yo Shikiso), Brilliant-carmine 6B (San-yo Shikiso) and Alizarin-reiku etc. are used, as a blue pigment, Serurian-blue, Sumikaprinto-cyanine-blue GNO (Sumitomo) and Copper phthalocyanine blue etc. are used and as a black pigment, carbon black and oil black etc. are used. Besides the foregoing, metallic particles and metal oxides may also be used.

As softening agents used for the present invention, polymers with a low softening point selected from ethyleneethylacrylate copolymer and ethylene-vinylacetate copolymer etc. are given.

As a cross-linking agent used in the interlayer of the present invention, compounds having plural functional groups are given. For example, amines (e.g. hexamethylenediamine), phenols (e.g. bisphenol A), carboxylic acids (e.g. terephtalic acid) and alcohols (e.g. ethyleneglycol) etc. are used.

As a support used for the thermal transfer recording medium of the present invention, the support having the strength for heat resistance and high dimensional stability as well as high surface smoothness is desirable. As materials of the support, papers such as ordinary paper, condenser paper, laminated paper, coated paper and others, films such as polyethylene, polyethyleneterephthalate, polystyrene, polypropylene, polyimide and others, paper-resin film complex and metallic sheets such as aluminum foil and others are favorably used. The thickness of the support is usually 60 μm or less and is especially 2–20 μm which is preferable for the excellent thermal conductivity. Furthermore, the structure at the reverse side of the support of the thermal transfer recording medium of the present invention is free and therefore a backing layer such as a sticking-prevention layer or the like may be provided on the reverse side.

In the thermal transfer recording medium of the present invention, the technology suitable for coating a foundation layer on the support such as polymer film or the like and the technology suitable for coating the heat-melting coloring agent layer on the foundation layer are described in aforesaid Japanese Patent Publication Open to Public Inspection Nos. 68253/1979 and 105579/1980 and therefore they are widely known in the present industry and may be used for the present invention. For example, the heat-melting coloring agent layer is a layer formed through the hot-melt-coating of the constituents thereof or through the solvent-coating of the coating liquid wherein aforesaid consitituents are solved or dispersed in the optimum solvent. As a coating method for the heat-melting coloring agent layer of the present invention, any known technology such as a reverse-roll-coater method, an extrusion-coater method, a gravure-coater method or a wire-bar coating method etc. may be employed. The thickness of the heat-melting coloring agent layer of the present invention is 20 μm or less and preferably is 1–15 μm. Further, the interlayer of the present invention has the thickness in the range of from 0.1 μm to 3 μm and preferably has the thickness from 0.1 to 1 μm.

EXAMPLES

Examples are given as follows and the embodiment of the present invention is not limited to such examples. Incidentally, the expression used below means "parts by weight".

Example 1

As an interlayer, 20% ethanol solution of hexamethylene diamine was coated on the polyethyleneterephthalate film with a 6 μm thickness with use of a wire bar so that the thickness of the dried coated layer was 0.6 μm. On the interlayer, a coloring agent layer composed of the following constituents was coated with use of a wire bar so that the thickness of the dried coated layer was 8.0 μm and then it was heated in the drier at 80° C. for 20 minutes, thus the sample "1" of the thermal transfer recording medium of the present invention was obtained.

| Composition of coating liquid for coloring agent layer | |
|---|---|
| carbon black | 10 parts |
| micro-crystalline wax (Micro UHF made by Petrolite Co.) | 40 parts |
| methylmethacrylatediglycyl-methacrylate copolymer (percent by weight 74:26, epoxy value 510) | 5 parts |
| toluene | 120 parts |

This sample "1" of the thermal transfer recording medium was used on the thermal printer (a trial model equipped with a thin type line thermal head having the heating element density of 8 dots/mm) which emitted the energy of 0.6 W per heating element in terms of electric power and of 1 millsecond in terms of impression time and thereby the recording (printing) was performed on the ordinary paper. This was repeated four times with use of the same sample of the thermal transfer recording medium. Incidentally, the wood free paper (60 g/m$^2$) on the market was used as an ordinary paper.

As a result of aforesaid recording (printing), the printing with sufficient density was obtained even in the fourth recording, as is shown by "1" in FIG. 1. The image quality of the printing was also excellent.

Comparative Example 1

As a comparative example, the coating liquid for the coloring agent layer which contains the same ingredients as those of aforesaid coating liquid for the coloring agent layer except methylmethacrylatediglycylmethacrylate copolymer was coated without coating the interlayer, and thus the comparative sample "2" of thermal transfer recording medium was obtained. Using this sample "2" of thermal transfer recording medium, the printing was performed on the thermal printer in the same manner as the Example 1. As a result of the printing, the density (Dmax) was low as shown by "2" in FIG. 1 and printing quality was poor.

Comparative Example 2

As a comparative example, the comparative example "3" of thermal transfer recording medium was obtained in the same way as aforesaid sample "1" of the present invention except that the interlayer in the sample "1" was changed to the layer made of polyvinylbutyral (Eslec BL-1, made by Sekisui Kagaku Co.) (softening point 120° C.). Using the sample "3" of thermal transfer recording medium, the printing was performed on the thermal printer in the same way as the Example 1. As a result of the printing, the density (Dmax) was low and the printing quality was poor.

What is claimed is:

1. A thermal transfer recording medium comprising a support, an interlayer provided on said support and a coloring agent layer provided on said interlayer, said coloring agent layer contains a coloring agent and a reactive polymer and said interlayer contains a cross-linking agent which reacts with said reactive polymer.

2. The thermal transfer recording medium according to claim 1, wherein said reactive polymer has a reactive group in the side chain thereof.

3. The thermal transfer recording medium according to claim 2, wherein said reactive group is selected from epoxy group, aziridinyl group, isocyanate group, thioisocyanate group, lactone group, ketene group, azlactone group, aldehyde group, vinyl group, amino group, mercapto group, acid hydrazide group, hydroxamic acid group, sulfonic acid chloride, acid azide group, sulfonic acid group, acid hydride group and triazine group.

4. The thermal transfer recording medium according to claim 2, wherein said coloring agent layer contains a heat-fusible substance having the melting point of from 40° C. to 120° C.

5. The thermal transfer recording medium according to claim 4, wherein said substance with a melting point of 40°–120° C. is micro-crystalline wax.

6. The thermal transfer recording medium according to claim 2, wherein said coloring agent layer further contains a plasticizer.

7. The thermal transfer recording medium according to claim 6, wherein said plasticizer is an ethylene-ethylacrylate copolymer or ethylene-vinylacetate copolymer.

8. The thermal transfer recording medium according to claim 2, wherein said coloring agent is selected from a group consisting of direct dyes, acid dyes, basic dyes, disperse dyes, oil-soluble dyes and pigments.

9. The thermal transfer recording medium according to claim 2, wherein said coloring agent layer has the thickness in the range of from 1 μm to 15 μm.

10. The thermal transfer recording medium according to claim 2, wherein said reactive polymer is methylmethacrylatediglycylmethacrylate copolymer.

11. The thermal transfer recording medium according to claim 1 wherein said coloring agent layer contains a heat-fusible substance having the melting point of from 40° C. to 120° C.

12. The thermal transfer recording medium according to claim 1, wherein said coloring agent layer further contains a plasticizer.

13. The thermal transfer recording medium according to claim 1, wherein said coloring agent is selected from a group consisting of direct dyes, acid dyes, basic dyes, disperse dyes, oil-soluble dyes and pigments.

14. The thermal transfer recording medium according to claim 13, wherein said coloring agent is carbon black.

15. The thermal transfer recording medium according to claim 12, wherein said plasticizer is an ethyleneethylacrylate copolymer or ethylene-vinylacetate copolymer.

16. The thermal transfer recording medium according to claim 1, wherein said cross-linking agent is selected from the group consisting of amine compounds, phenol compounds, carboxylic compounds and alcohol compounds.

17. The thermal transfer recording medium according to claim 16, wherein said interlayer has the thickness in the range of from 0.1 μm to 3 μm.

18. The thermal transfer recording medium according to claim 16, wherein said cross-linking agent is hexamethylene diamine.

19. The thermal transfer recording medium according to claim 1, wherein said medium has a backing coat layer.

20. The thermal transfer recording medium according to claim 19, wherein said backing coat layer is a sticking-prevention layer.

21. The thermal transfer recording medium according to claim 1, wherein said coloring agent layer has the thickness in the range of from 1 μm to 15 μm.

22. The thermal transfer recording medium according to claim 1, wherein said interlayer has the thickness in the range of from 0.1 μm to 3 μm.

23. A thermal transfer recording medium comprising a support, an interlayer provided on said support and a coloring agent layer provided on said interlayer, said coloring agent layer contains a carbon black coloring agent and a methylmethacrylatediglycylmethacrylate copolymer and said interlayer contains a hexamethylene diamine cross-linking agent which reacts with said copolymer.

24. The thermal transfer recording medium according to claim 23, wherein said coloring agent layer contains microcrystalline wax.

25. The thermal transfer recording medium according to claim 24, wherein said support is polyethylene terephthalate.

26. A process of preparing a thermal transfer recording medium comprising:

(1) coating an interlayer containing a cross-linking layer on a support;

(2) coating a coloring agent layer containing a coloring agent and a reactive polymer on said interlayer; and (3) thereafter reacting said cross-linking agent and said reactive polymer with each other.

27. The process of preparing a thermal transfer recording medium according to claim 26, wherein said reactive polymer has a reactive group in the side chain thereof.

* * * * *